US008381794B2

(12) United States Patent
Meier et al.

(10) Patent No.: US 8,381,794 B2
(45) Date of Patent: Feb. 26, 2013

(54) MOLD FOR THE CONTINUOUS CASTING OF PRELIMINARY SECTIONS, IN PARTICULAR DOUBLE T-SHAPED PRELIMINARY SECTIONS

(75) Inventors: Thomas Meier, Schaffhausen (CH); Beat Kundig, Zurich (CH)

(73) Assignee: SMS Concast AG, Zurich (CH)

( * ) Notice: Subject to any disclaimer, the term of this patent is extended or adjusted under 35 U.S.C. 154(b) by 0 days.

(21) Appl. No.: 13/319,722

(22) PCT Filed: May 30, 2010

(86) PCT No.: PCT/EP2010/003272

§ 371 (c)(1),
(2), (4) Date: Nov. 10, 2011

(87) PCT Pub. No.: WO2010/139437

PCT Pub. Date: Dec. 9, 2010

(65) Prior Publication Data

US 2012/0055648 A1 Mar. 8, 2012

(30) Foreign Application Priority Data

Jun. 3, 2009 (EP) ..... 09405091

(51) Int. Cl.
*B22D 11/041* (2006.01)

(52) U.S. Cl. ..... 164/418; 164/459

(58) Field of Classification Search ..... 164/418, 164/459

See application file for complete search history.

(56) References Cited

U.S. PATENT DOCUMENTS

| | | | | |
|---|---|---|---|---|
| 3,416,222 | A | 12/1968 | Pearson | |
| 4,834,167 | A * | 5/1989 | Streubel | 164/418 |
| 5,598,885 | A * | 2/1997 | Meroni et al. | 164/478 |
| 5,615,731 | A | 4/1997 | Roehrig et al. | |
| 6,612,363 | B1 | 9/2003 | Lorento | |
| 2006/0278363 | A1 | 12/2006 | Roehrig et al. | |
| 2009/0139684 | A1 | 6/2009 | Wobker et al. | |

FOREIGN PATENT DOCUMENTS

| | | | |
|---|---|---|---|
| WO | 2008043423 | A1 | 4/2008 |

* cited by examiner

*Primary Examiner* — Kuang Lin
(74) *Attorney, Agent, or Firm* — Brian Roffe

(57) ABSTRACT

Mold for the continuous casting of preliminary sections, in particular double T-shaped preliminary sections, such as beam blank sections or similar sections, wherein all the interior walls of the mold in a mold passage have a tapered course running linearly from top to bottom, this tapered course being dimensioned depending on the degree of shrinkage of the cast strand and produced by machining the interior walls. In this manner, it is possible to optimally adjust the diameter of the mold to the shrinkage process of the cast strand in the region of the mold passage, even for large-sized sections.

20 Claims, 3 Drawing Sheets

MOLD FOR THE CONTINUOUS CASTING OF PRELIMINARY SECTIONS, IN PARTICULAR DOUBLE T-SHAPED PRELIMINARY SECTIONS

FIELD OF THE INVENTION

The invention relates to a mould for the casting of preliminary sections, in particular double T-shaped preliminary sections, the mould passage of which in the flow direction of the molten mass is provided with slight tapering.

BACKGROUND OF THE INVENTION

As is well known, the tapering of the mould passage serves to compensate for the shrinkage of the cast strand that takes place within the mould during the solidification process. The production of this tapering is particularly problematic with large sized double T-shaped preliminary sections or beam blank sections because the latter are essentially produced from a tubular semi-finished product by forming, and because such sections have very large dimensions which can be over 800 mm total width, over 400 mm flange width and over 120 mm bar thickness. Since casting is slower with such large sizes than with smaller sizes, one requires for them a relatively large degree of tapering in the mould. However, in conventional moulds this tapering can only be produced to a limited extent because it is well known that the mould passage of the latter is produced during forming by means of a punch which is drawn as a female mould through a tubular blank or semi-finished product. Therefore, according to the known production method one can not in any case produce tapering towards the centre of the mould with the lateral inner sides of the profile because it is simply not possible to change the cross-section of the female mould used.

OBJECTS AND SUMMARY OF THE INVENTION

The object forming the basis of the invention is to provide a mould for large-sized sections which are particularly suitable for the casting of large T-shaped preliminary sections or beam blank formats because they satisfy the associated casting requirements with regard to the tapering of the mould passage.

This object is achieved according to the invention in that all of the interior walls of the mould in the mould passage respectively have tapering running from the upper to the lower side of the mould towards the centre of the mould.

In this way it is possible, particularly with large-sized sections, to adapt the mould cross-section optimally to the likewise linear shrinkage profile of the cast strand in the region of the mould passage. The machining, for example by means of milling, planing or polishing, is prior art in its own right, but the application according to the invention to the production of the mould is novel. It enables precise machining of the interior surfaces of the mould, respectively depending on the dimensions of the section to be produced.

The particular cross-section of the beam blank sections is associated with the fact that the degree of shrinkage of the cast strand varies greatly within the section cross-section. For example, it is smaller with the relatively narrow bar than in the longitudinal direction of the section. Therefore, provision is made according to the invention to optimise the strand formation such that every interior wall is provided with tapering dimensioned individually depending on the degree of shrinkage of the cast strand.

Furthermore, the invention makes provision such that the interior walls of the mould are formed linearly, curvilinearly, bent, parabolically or similarly.

BRIEF DESCRIPTION OF THE DRAWINGS

In the following the invention is described in more detail by means of an exemplary embodiment with reference to the drawings. These show as follows.

DETAILED DESCRIPTION OF THE INVENTION

Figure 1:
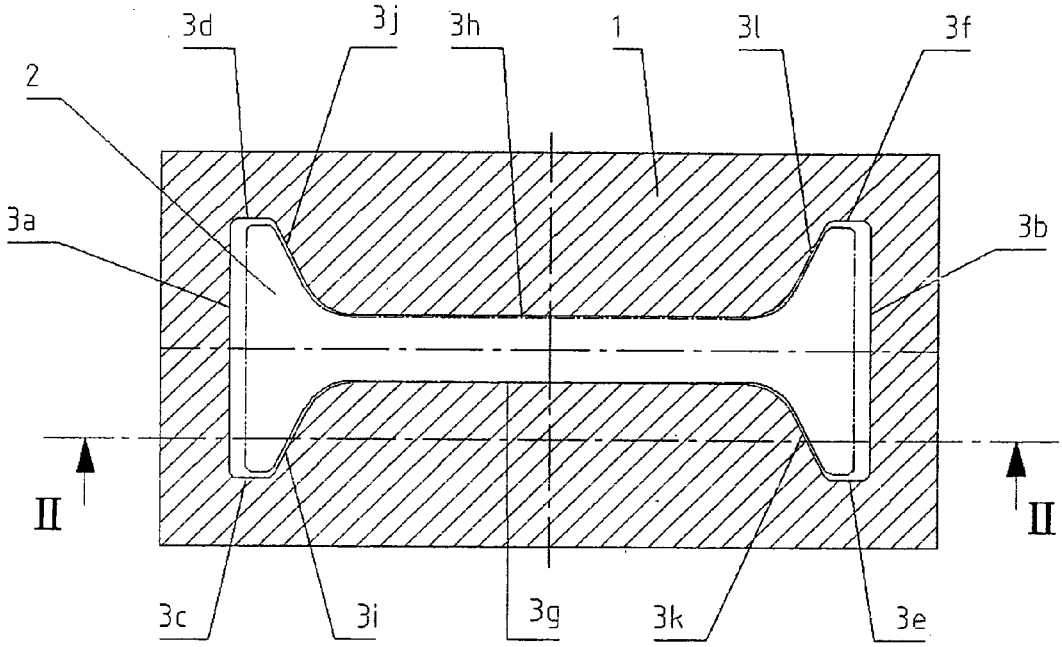
FIG. 1 is a conventional mould for beam blank sections, shown in a top view.
Figure 2:
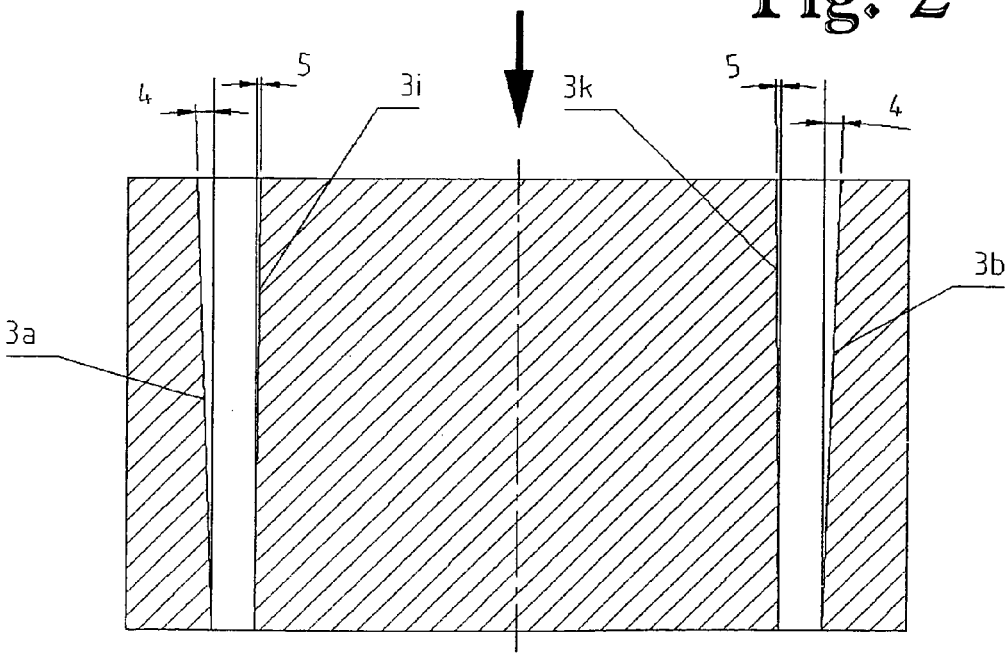
FIG. 2 is a longitudinal section along line II-II in FIG. 1.

The conventional mould 1 shown in FIG. 1 and FIG. 2 has a mould passage 2 with a double T-shaped cross-section corresponding to the cross-section of the section to be cast. The mould passage 2 is formed by the interior walls 3*a* to 3*l*. The latter are produced by means of a punch which is drawn as a female mould through a tubular blank. In FIG. 1 the lower end of the mould 1 is also indicated by a dashed line.

In order to compensate for the shrinkage of the cast strand that occurs during the solidification process, the interior walls 3*a* to 3*f* are produced with tapering 4. In contrast, the lateral interior walls 3*i*, 3*j* and 3*k*, 3*l* of this double T have tapering 5 because only in this way can the punch be extracted after the forming.

The mould 6 according to the invention of FIG. 3 to FIG. 6 essentially differs from the conventional mould 1 in that in the latter all of the interior walls 7*a* to 7*l* in the mould passage 8 respectively have tapering 9 to 12 extending from the upper to the lower side of the mould towards the centre of the mould passage.

The centre of the mould passage can be understood to be the central axis 1' itself or the plane lateral to the longitudinal form of the mould cross-section. Strictly speaking, the solidification of the molten mass in the mould takes place towards the central axis. So that one does not, however, have to provide non-linear surfaces on these internal walls, as viewed laterally to the passage 2, in this direction they can be formed approximately linearly. The central axis can be a straight line or also curved when the mould passage forms a radius, in particular when the cast strand is guided about a radius from a vertical into a horizontal plane. The radius or the curvature would extend in the normal way perpendicular to the longitudinal form of the mould passage.

Advantageously the interior walls 7*a* to 7*l* are in the form of curved surfaces. They are shaped here with a curvature such that they are adapted to the solidification of the strand cast in the latter which does not take place linearly over the height of the mould. It can be, for example, that the strand already solidifies rapidly in the upper region of the mould, and then only shrinks minimally. Accordingly, these interior walls would already have to be reduced in the upper region of the mould to a relatively large extent and then be changed only minimally towards the inside in the lower region. Therefore, they can be formed linearly, curvilinearly, bent, parabolically or similarly as required.

Figure 3:
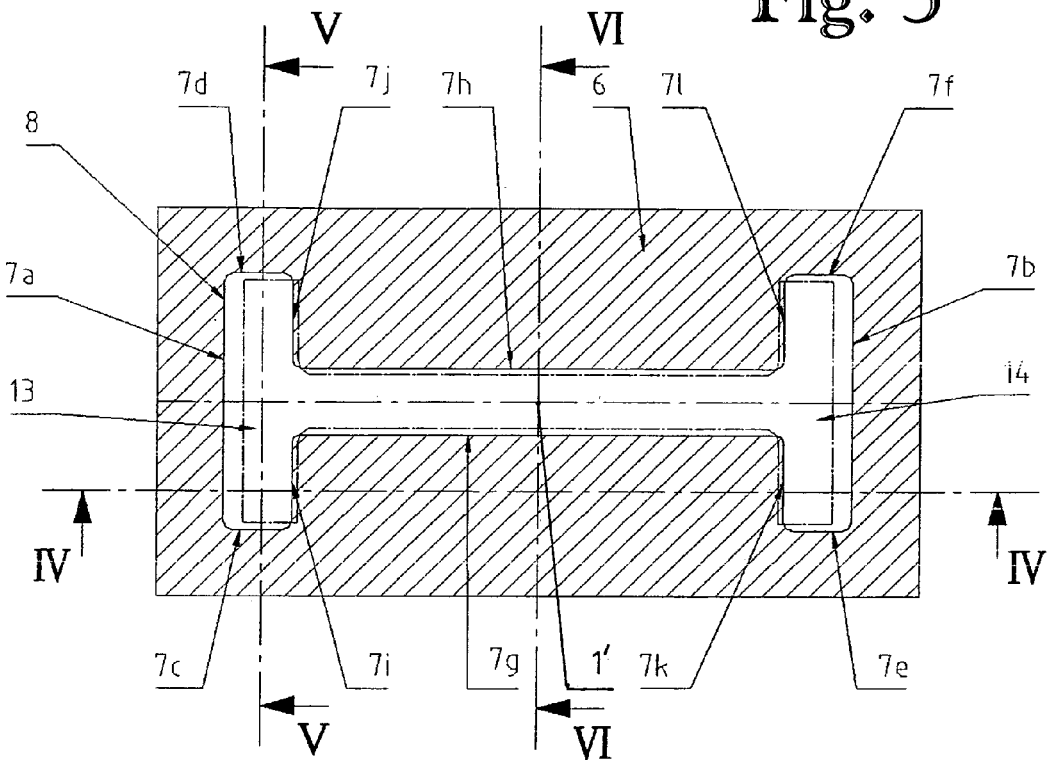
FIG. 3 is a mould according to the invention with a double T-shaped cross-section, shown in a top view.
Figure 4:
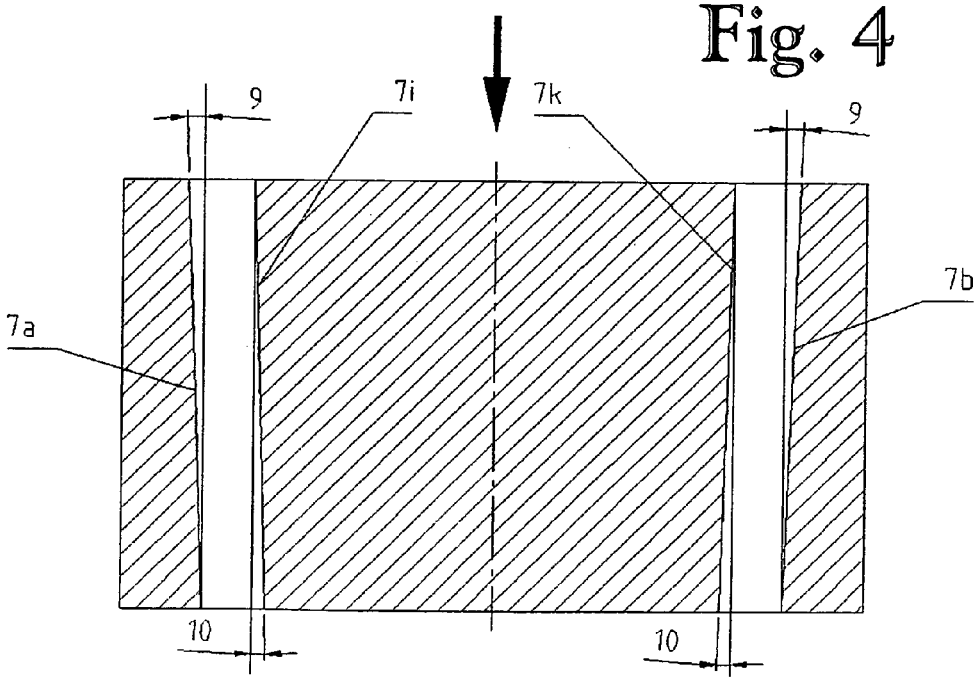
FIG. 4 is a longitudinal section along line IV-IV in FIG. 3.
Figure 5:
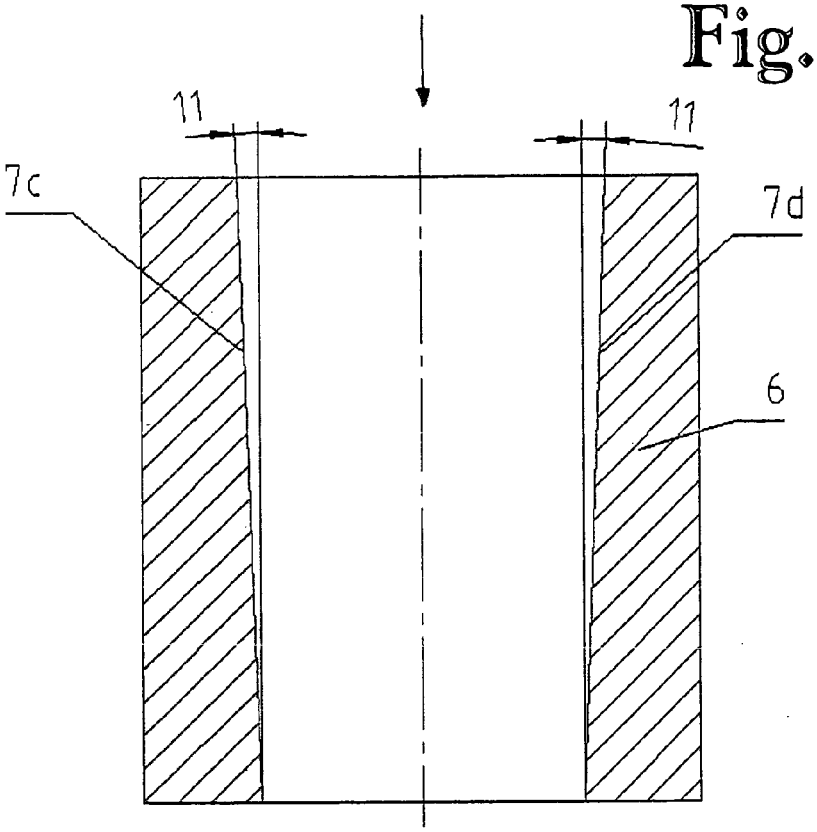
FIG. 5 is a cross-section along line V-V in FIG. 3.
Figure 6:
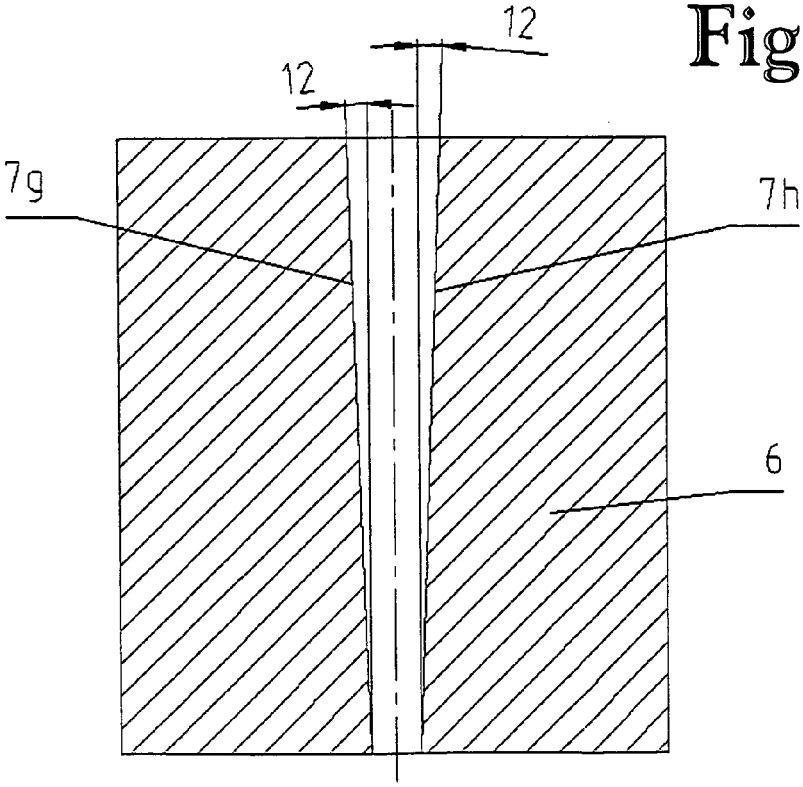
FIG. 6 is a further cross-section along line VI-VI in FIG. 3.

The tapering 9 to 12 of the interior walls 7*a* to 7*l* is dimensioned such that they compensate everywhere for the shrinkage occurring there. For clarification FIG. 1 and FIG. 3 show the upper side of the mould passage with extended lines, and meanwhile the lower side is shown by dashed and dotted lines. Furthermore, in FIG. 4 the direction of continuous casting is indicated by the arrow above the mould.

The mould 6 enables the continuous casting of particularly large-sized sections because, by means of the machining of the mould passage according to the invention, a correspondingly large degree of tapering can also be achieved which, moreover, is adapted to the local degree of shrinkage of the cast strand within the mould passage.

The mould according to the invention can, of course, also be used for casting bone-shaped sections by the mould passage being provided with a correspondingly bone-shaped cross-section. It is suitable in general for the casting of large-sized sections, independently of the cross-sectional geometry of the section to be cast.

The embodiment according to the invention can also be used for repairing or reworking used moulds.

The invention claimed is:

1. A mould for the continuous casting of double T-shaped preliminary sections, having an upper side, a lower side and a mould passage between the upper side and the lower side, the mould passage tapering from the upper side to the lower side of the mould, the mould passage being defined by a plurality of interior walls, all of the interior walls tapering in a direction from the upper side to the lower side of the mould towards a center of the mould passage, the tapering of each of the interior walls being individually dimensioned depending on a degree of shrinkage of a strand cast in the mould.

2. The mould according to claim 1, wherein the interior walls that taper in the direction from the upper side to the lower side of the mould and toward the center of the mould passage have a linear shape.

3. The mould according to claim 1, wherein the interior walls that taper in the direction from the upper side to the lower side of the mould and toward the center of the mould passage have a curvature such that they are adapted to solidification of the strand cast in the mould.

4. The mould according to claim 1, wherein the center of the mould passage is formed by a central axis of the mould passage.

5. The mould according to claim 2, wherein the center of the mould passage is formed by a central axis of the mould passage.

6. The mould according to claim 3, wherein the center of the mould passage is formed by a central axis of the mould passage.

7. The mould according to claim 1, wherein the center of the mould passage is defined in a plane passing through a central axis of the mould passage.

8. The mould according to claim 2, wherein the center of the mould passage is defined in a plane lateral to a longitudinal form of the mould and passing through a central axis of the mould passage.

9. The mould according to claim 3, wherein the center of the mould passage is defined in a plane passing through a central axis of the mould passage.

10. The mould according to claim 1, wherein the interior walls that taper in the direction from the upper side to the lower side of the mould and toward the center of the mould passage have a curvilinear shape.

11. The mould according to claim 1, wherein the interior walls that taper in the direction from the upper side to the lower side of the mould and toward the center of the mould passage have a curved shape.

12. The mould according to claim 1, wherein the interior walls that taper in the direction from the upper side to the lower side of the mould and toward the center of the mould passage have a parabolic shape.

13. The mould according to claim 1, wherein the interior walls that taper in the direction from the upper side to the lower side of the mould and toward the center of the mould passage include first and second opposed interior walls that define a web portion of the mould.

14. The mould according to claim 1, wherein the interior walls that taper in the direction from the upper side to the lower side of the mould and toward the center of the mould passage include a plurality of walls that define each of two flange portions of the mould.

15. The mould according to claim 1, wherein the interior walls that taper in the direction from the upper side to the lower side of the mould and toward the center of the mould passage include first and second opposed interior walls that define a web portion of the mould and a plurality of additional walls that define each of two flange portions of the mould.

16. The mould according to claim 1, wherein the interior walls that taper in the direction from the upper side to the lower side of the mould and toward the center of the mould passage include a plurality of opposed walls that define each of two flange portions of the mould.

17. The mould according to claim 1, wherein the interior walls that taper in the direction from the upper side to the lower side of the mould and toward the center of the mould passage taper entirely from the upper side to the lower side of the mold such that a lower region of each interior wall including a lower edge is closer to the center of the mould passage than an upper region of the same interior wall including an upper edge.

18. The mould according to claim 17, wherein each of the interior walls has a curved form between the upper region and the lower region.

19. The mould according to claim 17, wherein each of the interior walls has a linear form between the upper region and the lower region.

20. The mould according to claim 17, wherein each of the interior walls has a parabolic form between the upper region and the lower region.

* * * * *

UNITED STATES PATENT AND TRADEMARK OFFICE

CERTIFICATE OF CORRECTION

PATENT NO. : 8,381,794 B2
APPLICATION NO. : 13/319722
DATED : February 26, 2013
INVENTOR(S) : Thomas Meier and Beat Kundig It is certified that error appears in the above-identified patent and that said Letters Patent is hereby corrected as shown below:

In the Specification:

Column 3, lines 53-54, delete "lateral to a longitudinal form of the mould and".

Signed and Sealed this
Sixteenth Day of April, 2013

Teresa Stanek Rea
*Acting Director of the United States Patent and Trademark Office*